US008638162B2

(12) United States Patent
Watanabe

(10) Patent No.: US 8,638,162 B2
(45) Date of Patent: Jan. 28, 2014

(54) REFERENCE CURRENT GENERATING CIRCUIT, REFERENCE VOLTAGE GENERATING CIRCUIT, AND TEMPERATURE DETECTION CIRCUIT

(75) Inventor: Kazunori Watanabe, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 37 days.

(21) Appl. No.: 13/243,290

(22) Filed: Sep. 23, 2011

(65) Prior Publication Data

US 2012/0075007 A1 Mar. 29, 2012

(30) Foreign Application Priority Data

Sep. 27, 2010 (JP) ..... 2010-215170

(51) Int. Cl.
*G05F 1/10* (2006.01)

(52) U.S. Cl.
USPC ..... 327/540; 327/539; 327/103; 323/312

(58) Field of Classification Search
USPC ..... 327/539, 513
See application file for complete search history.

(56) References Cited

U.S. PATENT DOCUMENTS 5,545,972 A * 8/1996 Kiehl ..... 323/315
5,638,031 A 6/1997 Danstrom
5,892,402 A * 4/1999 Tsubaki et al. ..... 330/288
5,900,773 A * 5/1999 Susak ..... 327/539
5,952,884 A * 9/1999 Ide ..... 330/288
5,990,753 A 11/1999 Danstrom et al.
6,198,198 B1 3/2001 Fujimura et al.
6,362,688 B1 * 3/2002 Au ..... 330/261
7,199,646 B1 * 4/2007 Zupcau et al. ..... 327/539
7,511,568 B2 * 3/2009 Kimura ..... 327/539
7,683,701 B2 * 3/2010 Georgescu et al. ..... 327/539

(Continued)

FOREIGN PATENT DOCUMENTS

EP 0 786 865 A1 7/1997
EP 0 881 765 A2 12/1998

(Continued)

OTHER PUBLICATIONS

Banba, H et al., "A CMOS Bandgap Reference Circuit with Sub-I-V Operation," IEEE Journal of Solid-State Circuits, May 1, 1999, vol. 34, No. 5, pp. 670-674.

(Continued)

*Primary Examiner* — Thomas J Hiltunen
(74) *Attorney, Agent, or Firm* — Fish & Richardson P.C.

(57) ABSTRACT

A reference current generating circuit with high current mirror accuracy is provided by low power supply voltage operation. The reference current generating circuit includes a cascode current mirror circuit 1 outputting mirror currents I1 and I2, and a reference current Iref, a current-voltage converter circuit 2 converting the mirror current I1 into a voltage V1, a current-voltage converter circuit 3 converting the mirror current I2 into a voltage V2, a differential amplifier 4 in which the voltage V1 is input to a first input terminal and the voltage V2 is input to a second input terminal, a voltage-current converter circuit 5 converting a voltage V3 output from the differential amplifier 4 into currents I3 and I4, and a current-voltage converter circuit 6 converting the current I3 into a voltage V4 which is output to a gate of a transistor in the cascode current mirror circuit.

18 Claims, 7 Drawing Sheets

(56) References Cited

U.S. PATENT DOCUMENTS

| | | | | |
|---|---|---|---|---|
| 8,310,279 | B2 * | 11/2012 | Sudjian | 327/65 |
| 2002/0042965 | A1 | 4/2002 | Salem et al. | |
| 2007/0194837 | A1 * | 8/2007 | Chiou et al. | 327/543 |
| 2010/0214013 | A1 * | 8/2010 | Shibayama | 327/539 |
| 2011/0043185 | A1 * | 2/2011 | Kim | 323/313 |
| 2012/0056863 | A1 | 3/2012 | Watanabe et al. | |

FOREIGN PATENT DOCUMENTS

| | | | |
|---|---|---|---|
| JP | 59-207723 | A | 11/1984 |
| JP | 61-035438 | U | 3/1986 |
| JP | 62-290208 | A | 12/1987 |
| JP | 03-007417 | A | 1/1991 |
| JP | 04-168803 | A | 6/1992 |
| JP | 04-334114 | A | 11/1992 |
| JP | 09-146648 | A | 6/1997 |
| JP | 11-045125 | A | 2/1999 |
| JP | 11-103239 | A | 4/1999 |
| JP | 2000-339049 | A | 12/2000 |

OTHER PUBLICATIONS

Yang, Wet al., "A Sub-1-V Linear CMOS Bandgap Voltage Reference," HDP 2005: Conference on High Density Microsystem Design and Packaging and Component Failure Analysis, 2005, Jun. 27, 2005, pp. 1-4, IEEE.

* cited by examiner

REFERENCE CURRENT GENERATING CIRCUIT, REFERENCE VOLTAGE GENERATING CIRCUIT, AND TEMPERATURE DETECTION CIRCUIT

BACKGROUND OF THE INVENTION

1. Field of the Invention

The present invention relates to a reference current generating circuit, and a reference voltage generating circuit and a temperature detection circuit using the reference current generating circuit. In particular, the present invention relates to a reference current generating circuit including a MOS transistor, and a reference voltage generating circuit and a temperature detection circuit using the reference current generating circuit.

2. Description of the Related Art

A variety of semiconductor devices requires a reference voltage for operating. As a circuit generating such a reference voltage, a band gap reference circuit is known. A band gap reference circuit can supply a voltage higher than or equal to the band gap of silicon (about 1.25 V) without depending on temperature. Note that the band gap reference circuit was incapable of supplying a voltage lower than the band gap as a reference voltage.

In contrast, a reference voltage generating circuit that can generate a reference voltage lower than the band gap with a low power supply voltage which is lower than the band gap is disclosed in Patent Document 1. The reference voltage generating circuit disclosed in Patent Document 1 generates a reference current with small dependence on temperature and generates a reference voltage by converting the reference current into a voltage in a current-voltage converter circuit constructed by using resistors alone.

REFERENCE

[Patent Document 1] Japanese Published Patent Application No. H11-045125

SUMMARY OF THE INVENTION

The reference voltage generating circuit disclosed in Patent Document 1 includes two current-voltage converter circuits each including a diode (a diode-connected transistor) and a resistor, a differential amplifier, a current mirror circuit, and an output circuit including a resistor. The differential amplifier is provided for controlling two voltages generated by the two current-voltage converter circuits to be equal to each other. An output terminal of the differential amplifier is electrically connected to a gate of a p-channel transistor included in the current mirror circuit, whereby currents that are equal to each other are supplied to the current mirror circuit. Thus, a current obtained by a forward voltage of a diode having a negative temperature coefficient and a current obtained by a voltage difference between two diodes having a positive temperature coefficient are added, so that a reference current with a small temperature coefficient is generated. The reference current is output to the output circuit by using the current mirror circuit and converted into a reference voltage in the output circuit, so that the reference voltage is generated. Note that the current mirror circuit includes a plurality of p-channel transistors in which an output signal of the differential amplifier is input to respective gates.

Channel length modulation effect of a transistor included in an integrated circuit appears as the rules of process of the integrated circuit become fine. This leads directly to a decrease in the current mirror accuracy of the current mirror circuit included in the reference voltage generating circuit. In other words, because drains of the plurality of p-channel transistors included in the current mirror circuit are connected to different portions, the source-drain voltages ($V_{DS}$) of the p-channel transistors are different from each other. Consequently, currents each generated between the respective sources and drains of the p-channel transistors are not equal and the current values of the p-channel transistors vary from each other. In addition, there is a problem in that the currents of the p-channel transistors change in response to the change in power supply voltages input to the sources of the plurality of p-channel transistors (i.e., a decrease in power supply rejection ratio).

This problem can be solved by using a cascode current mirror circuit as the current mirror circuit. Here, a typical cascode current mirror circuit is shown in FIG. 7A. In the current mirror circuit shown in FIG. 7A, a voltage higher than or equal to ($V_{th}$M1+$V_{ov}$M1+$V_{th}$M2+$V_{ov}$M2) is required in order to operate p-channel transistors M1 and M2 in a saturation region. Note that $V_{th}$M1 is a threshold voltage of the p-channel transistor M1; $V_{ov}$M1 is an overdrive voltage of the p-channel transistor M1; $V_{th}$M2 is a threshold voltage of the p-channel transistor M2; and $V_{ov}$M2 is an overdrive voltage of the p-channel transistor M2. In general, $V_{th}$M1 and $V_{th}$M2 are each about 0.6 V, and $V_{ov}$M1 and $V_{ov}$M2 are each about 0.2 V, and a voltage higher than or equal to 1.6 V is required for the operation of the current mirror circuit. Therefore, in the case where the current mirror circuit shown in FIG. 7A is used in the reference voltage generating circuit, it is impossible to operate the reference voltage generating circuit at a low power supply voltage lower than 1.25 V.

Further, a cascode current mirror circuit is known as a circuit which is capable of operating at a low power supply voltage lower than that of the current mirror circuit shown in FIG. 7A. This current mirror circuit is shown in FIG. 7B. In the current mirror circuit shown in FIG. 7B, a voltage higher than or equal to ($V_{th}$M3+$V_{ov}$M3) is required and Vb≥($V_{ov}$M3+$V_{th}$M4+$V_{ov}$M4) and $V_{th}$M3≥$V_{ov}$M4 need to be satisfied in order to operate p-channel transistors M3 and M4 in a saturation region. Note that $V_{th}$M3 is a threshold voltage of the p-channel transistor M3; $V_{ov}$M3 is an overdrive voltage of the p-channel transistor M3; $V_{th}$M4 is a threshold voltage of the p-channel transistor M4; $V_{ov}$M4 is an overdrive voltage of the p-channel transistor M4; and Vb is a voltage input from the outside. In general, $V_{th}$M3 and $V_{th}$M4 are each about 0.6 V, and $V_{ov}$M3 and $V_{ov}$M4 are each about 0.2 V, and application of a voltage higher than or equal to 0.8 V is necessary and Vb needs to be higher than or equal to 1.0 V for the operation of the current mirror circuit. Therefore, in the case where the current mirror circuit shown in FIG. 7B is used in the reference voltage generating circuit, it is possible to operate at a low power supply voltage lower than 1.25 V, to improve the current mirror accuracy, and to prevent a decrease in power supply rejection ratio.

However, in the case where the cascode current mirror circuit shown in FIG. 7B is used in the reference voltage generating circuit, all of the transistors included in the cascode current mirror circuit need to be operated in a saturation region, so how to generate Vb satisfying the above conditions is a problem.

In view of the above problem, an object of one embodiment of the present invention is to provide a reference current generating circuit including a cascode current mirror circuit with high current mirror accuracy by low power supply voltage operation. Further, an object of one embodiment of the present invention is to provide a reference voltage generating circuit or a temperature detection circuit using the reference current generating circuit.

One embodiment of the present invention is a reference current generating circuit including: a cascade current mirror circuit; a first current-voltage converter circuit converting a first mirror current which is output from the current mirror circuit and input to a first node into a first voltage; a second current-voltage converter circuit converting a second mirror current which is output from the current mirror circuit and input to a second node into a second voltage; a differential amplifier in which the first voltage is input to a first input terminal and the second voltage is input to a second input terminal; a voltage-current converter circuit converting a third voltage which is output from the differential amplifier into a third current to output to a third node, and converting the third voltage into a fourth current to output to a fourth node; and a third current-voltage converter circuit converting the third current into a fourth voltage to output to the third node. The third current-voltage converter circuit includes a first p-channel transistor. The current mirror circuit includes second to ninth p-channel transistors. Gates of the first to fifth p-channel transistors and a drain of the first p-channel transistor are electrically connected to the third node. A drain of the second p-channel transistor and gates of the sixth to ninth p-channel transistors are electrically connected to the fourth node. A drain of the third p-channel transistor is electrically connected to the first node. A drain of the fourth p-channel transistor is electrically connected to the second node. A drain of the sixth p-channel transistor is electrically connected to a source of the second p-channel transistor. A drain of the seventh p-channel transistor is electrically connected to a source of the third p-channel transistor. A drain of the eighth p-channel transistor is electrically connected to a source of the fourth p-channel transistor. A drain of the ninth p-channel transistor is electrically connected to a source of the fifth p-channel transistor. A source of the first p-channel transistor and sources of the sixth to ninth p-channel transistors are electrically connected to a high power supply potential line. A reference current is output from a drain of the fifth p-channel transistor.

Further, a reference voltage generating circuit including the above reference current generating circuit and a fourth current-voltage converter circuit converting the reference current into a reference voltage is one embodiment of the present invention.

Furthermore, a temperature detection circuit including the above reference current generating circuit and a detection circuit for detecting temperature using the reference current is one embodiment of the present invention.

A reference current generating circuit according to one embodiment of the present invention includes a current mirror circuit, which can have high current-mirror accuracy by operation at a low power supply voltage. For this reason, the reference current generating circuit with high accuracy and capable of low power supply voltage operation can be provided. Further, a reference voltage generating circuit or a temperature detection circuit according to one embodiment of the present invention generates a reference voltage using the reference current generating circuit. Consequently, a reference voltage generating circuit or a temperature detection circuit with high accuracy and capable of low power supply voltage operation can be provided.

DETAILED DESCRIPTION OF THE INVENTION

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be limited to the descriptions of the following embodiments.

<Structural Example of Reference Current Generating Circuit>

Figure 1A:
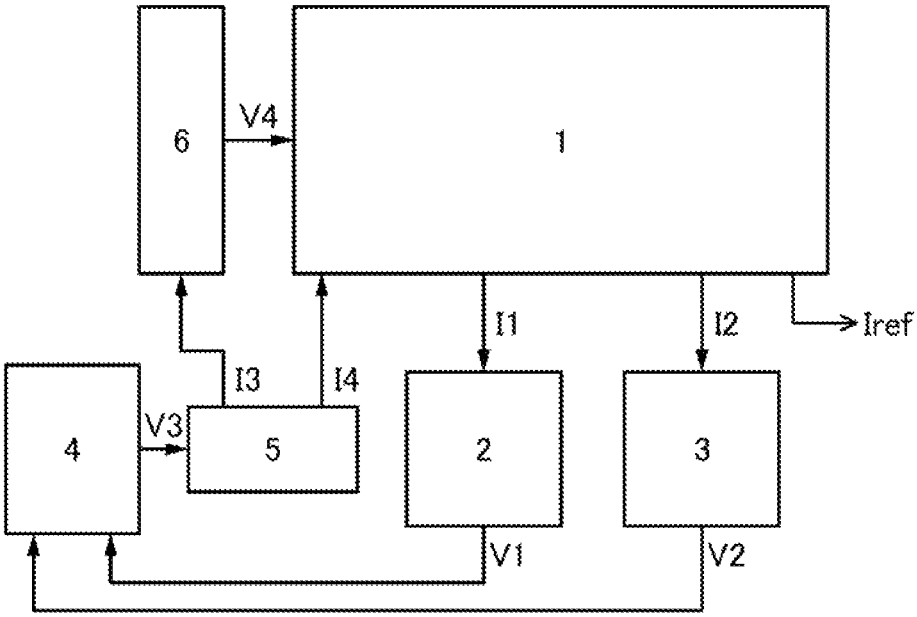
FIGS. 1A and 1B are circuit diagrams showing structural examples of a reference current generating circuit.
Figure 7A:
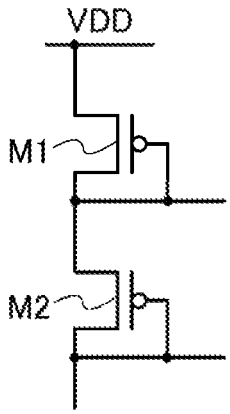
FIGS. 7A and 7B are diagrams for explaining a cascode connection.
Figure 7B:
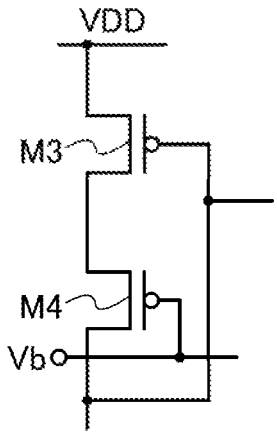

FIG. 1A is a circuit diagram showing a structural example of a reference current generating circuit according to one embodiment of the present invention. The reference current generating circuit shown in FIG. 1A includes a cascode current mirror circuit 1 outputting a reference current Iref, a current-voltage converter circuit 2 converting a mirror current I1 output from the current mirror circuit 1 into a voltage V1, a current-voltage converter circuit 3 converting a mirror current I2 output from the current mirror circuit 1 into a voltage V2, a differential amplifier 4 in which the voltage V1 is input to a first input terminal and the voltage V2 is input to a second input terminal, a voltage-current converter circuit 5 converting a voltage V3 output from the differential amplifier 4 into currents I3 and I4 and outputting the currents I3 and I4, and a current-voltage converter circuit 6 converting the current I3 into a voltage V4 and outputting the voltage V4. Note that the voltage V4 output from the current-voltage converter circuit 6 is a voltage input to a gate of a transistor included in a cascode connection in the cascode current mirror circuit (corresponds to the voltage Vb shown in FIG. 7B).

Figure 1B:
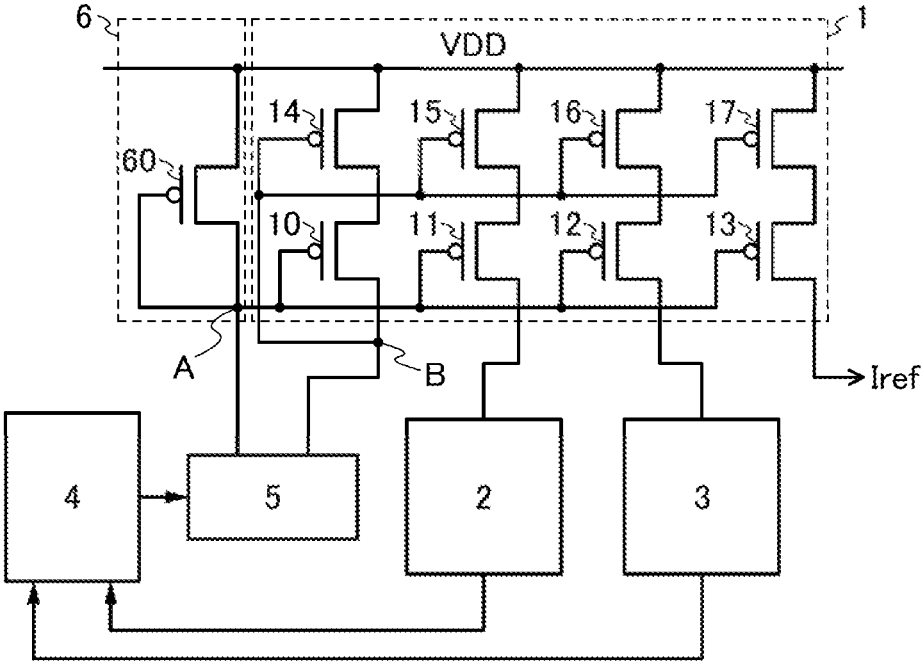

FIG. 1B shows a structural example of the cascode current mirror circuit 1 and the current-voltage converter circuit 6 included in the reference current generating circuit shown in FIG. 1A. The current-voltage converter circuit 6 shown in FIG. 1B includes a p-channel transistor 60 and the cascode current mirror circuit 1 shown in FIG. 1B includes p-channel transistors 10 to 17.

A gate of the p-channel transistor 60, gates of the p-channel transistors 10 to 13, and a drain of the p-channel transistor 60 are electrically connected to a node A to which the current I3 is output from the voltage-current converter circuit 5.

A drain of the p-channel transistor 10 and gates of the p-channel transistors 14 to 17 are electrically connected to a node B to which the current I4 is output from the voltage-current converter circuit 5.

A drain of the p-channel transistor 14 is electrically connected to a source of the p-channel transistor 10.

A drain of the p-channel transistor 15 is electrically connected to a source of the p-channel transistor 11.

A drain of the p-channel transistor 16 is electrically connected to a source of the p-channel transistor 12.

A drain of the p-channel transistor 17 is electrically connected to a source of the p-channel transistor 13.

A source Of the p-channel transistor 60 and sources of the p-channel transistors 14 to 17 are electrically connected to a wiring for supplying a high power supply potential (VDD) (also referred to as a high power supply potential line).

Further, a drain of the p-channel transistor 11, a drain of the p-channel transistor 12, and a drain of the p-channel transistor 13 function as a terminal outputting the mirror current I1, a terminal outputting the mirror current I2, and a terminal outputting the reference current Iref respectively.

Specifically, the currents I1 and I2 having a small temperature coefficient can be generated in the current mirror circuit by adding a current having a positive temperature coefficient and a current having a negative temperature coefficient in the current-voltage converter circuits 2 and 3. Then, the current is output from the drain of the p-channel transistor 13 included in the cascode current mirror circuit as the reference current Iref.

Here, in the reference current generating circuit shown in FIG. 1B, it is required that the voltage of the node A be controlled so that the p-channel transistors 10 to 17 operate in a saturation region. For example, based on the premise that the threshold voltages of the p-channel transistor 60 and the p-channel transistors 10 to 17 are $V_{th}$ and the (W/L) values of the p-channel transistors 10 to 17 are equal, the reference current generating circuit shown in FIG. 1B may be designed as follows.

First, Formula 1 needs to be satisfied in order for the p-channel transistors 10 to 17 to operate in a saturation region.

[Formula 1]

$$V_A \geq V_{th} + V_{ov}10 + V_{ov}14 \tag{1}$$

$V_A$, $V_{ov}$10, and $V_{ov}$14 are the voltage of the node A, the overdrive voltage of the p-channel transistor 10, and the overdrive voltage of the p-channel transistor 14 respectively.

The voltage of the node A can be expressed by Formula 2.

[Formula 2]

$$V_A = V_{th} + V_{ov}60 \tag{2}$$

From Formulae 1 and 2, Formula 3 may be satisfied in order for the p-channel transistors 10 and 14 to operate in a saturation region.

[Formula 3]

$$V_{ov}60 \geq V_{ov}10 + V_{ov}14 \tag{3}$$

Here, a drain current ($I_d$) is expressed by Formula 4.

[Formula 4]

$$I_d \propto \left(\frac{W}{L}\right) V_{ov}^2 \tag{4}$$

Therefore, an overdrive voltage ($V_{ov}$) is expressed by Formula 5.

[Formula 5]

$$V_{ov} \propto \sqrt{\frac{I_d}{(W/L)}} \tag{5}$$

From Formula 5, Formula 3 can be changed to Formula 6. Note that Formula 6 is based on the premise that the (W/L) values of the p-channel transistors 10 and 14 are equal.

[Formula 6]

$$\sqrt{\frac{I_d 60}{(W60/L60)}} \geqq 2\sqrt{\frac{I_d 10}{(W10/L10)}} \tag{6}$$

$I_d$60, W60, and L60 are the drain current of the p-channel transistor 60, the channel width of the p-channel transistor 60, and the channel length of the p-channel transistor 60 respectively. Similarly, $I_d$10, W10, and L10 are the drain current of the p-channel transistor 10, the channel width of the p-channel transistor 10, and the channel length of the p-channel transistor 10 respectively.

Consequently, the reference current generating circuit shown in FIG. 1B needs to be designed to satisfy Formula 6 in this premise. Specifically, the voltage of the node A shown in FIG. 1B can be higher than or equal to a voltage required for the p-channel transistors 10 and 14 to operate in a saturation region by setting the drain current ($I_d$60) of the p-channel transistor 60 to be larger than 4 times the drain current ($I_d$10) of the p-channel transistor 10 or setting the size (W60/L60) of the p-channel transistor 60 to be smaller than ¼ time the size (W10/L10) of the p-channel transistor 10. Thus, the reference current generating circuit shown in FIG. 1B with high accuracy and capable of low power supply voltage operation can be provided.

<Modification Example of Reference Current Generating Circuit>

The reference current generating circuit shown in FIG. 1B is one embodiment of the present invention and a reference current generating circuit having a different structure from that in FIG. 1B is also included in the present invention.

Figure 2A:
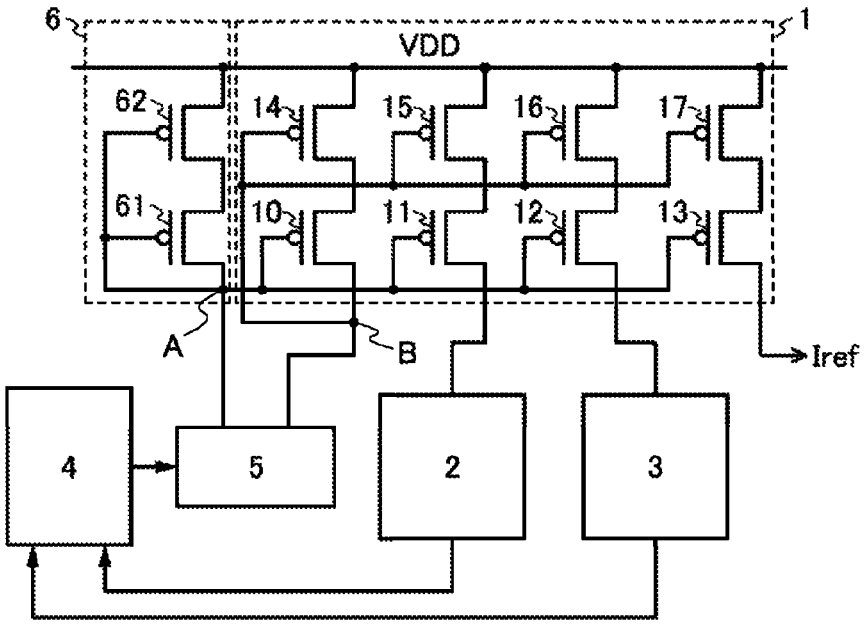
FIGS. 2A and 2B are circuit diagrams showing modification examples of a reference current generating circuit.

For example, FIG. 1B shows an example of the current-voltage converter circuit 6 including one p-channel transistor 60; however, the current-voltage converter circuit 6 can include two p-channel transistors 61 and 62 as shown in FIG. 2A. Specifically, gates of the p-channel transistors 61 and 62 shown in FIG. 2A and a drain of the p-channel transistor 61 are electrically connected to the node A to which the current I3 is output from the voltage-current converter circuit 5. A drain of the p-channel transistor 62 is electrically connected to a source of the p-channel transistor 61. A source of the p-channel transistor 62 is electrically connected to a high power supply potential line.

The voltage of the node A needs to be controlled so that the p-channel transistors 10 and 14 operate in a saturation region in the reference current generating circuit shown in FIG. 2A in a manner similar to that of the reference current generating circuit shown in FIG. 1B. For example, based on the premise that the threshold voltage of the p-channel transistors 61 and 62 and the p-channel transistors 10 to 17 are $V_{th}$ and the (W/L) value of the p-channel transistor 61 and the p-channel transistors 10 to 17 are equal, the reference current generating circuit shown in FIG. 2A may be designed as follows.

First, Formula 1 needs to be satisfied in order for the p-channel transistors 10 and 14 to operate in a saturation region.

The voltage of the node A is expressed by Formula 7.

[Formula 7]

$$V_A = V_{th} + V_{ov}61 + V_{ov}62 \tag{7}$$

From Formulae 1 and 7, Formula 8 may be satisfied in order for the p-channel transistors 10 and 14 to operate in a saturation region.

[Formula 8]

$$V_{ov}61 + V_{ov}62 \geq V_{ov}10 + V_{ov}14 \tag{8}$$

From Formula 5, Formula 8 can be changed to Formula 9. Note that Formula 9 is based on the premise that the (W/L) values of the p-channel transistors 61, 10, and 14 are equal.

[Formula 9]

$$\sqrt{\frac{I_d62}{(W62/L62)}} \geq \sqrt{\frac{I_d10}{(W10/L10)}} \tag{9}$$

$I_d$62, W62, and L62 are the drain current of the p-channel transistor 62, the channel width of the p-channel transistor 62, and the channel length of the p-channel transistor 62 respectively.

Consequently, the reference current generating circuit shown in FIG. 2A needs to be designed to satisfy Formula 9 in this premise. Specifically, the voltage of the node A shown in FIG. 2A can be higher than or equal to a voltage required for the p-channel transistors 10 and 14 to operate in a saturation region by setting the drain current ($I_d$62) of the p-channel transistor 62 to be larger than the drain current ($I_d$10) of the p-channel transistor 10 or setting the size (W62/L62) of the p-channel transistor 62 to be smaller than the size (W10/L10) of the p-channel transistor 10. Further, the reference current generating circuit shown in FIG. 2A is preferable because the above condition required for the voltage of the node A can be satisfied easier than in the reference current generating circuit shown in FIG. 1B. Thus, the reference current generating circuit shown in FIG. 2A with high accuracy and capable of low power supply voltage operation can be provided.

Note that the reference current generating circuit shown in FIG. 1B is preferable because the number of transistors can be small compared to the reference current generating circuit shown in FIG. 2A.

Figure 2B:
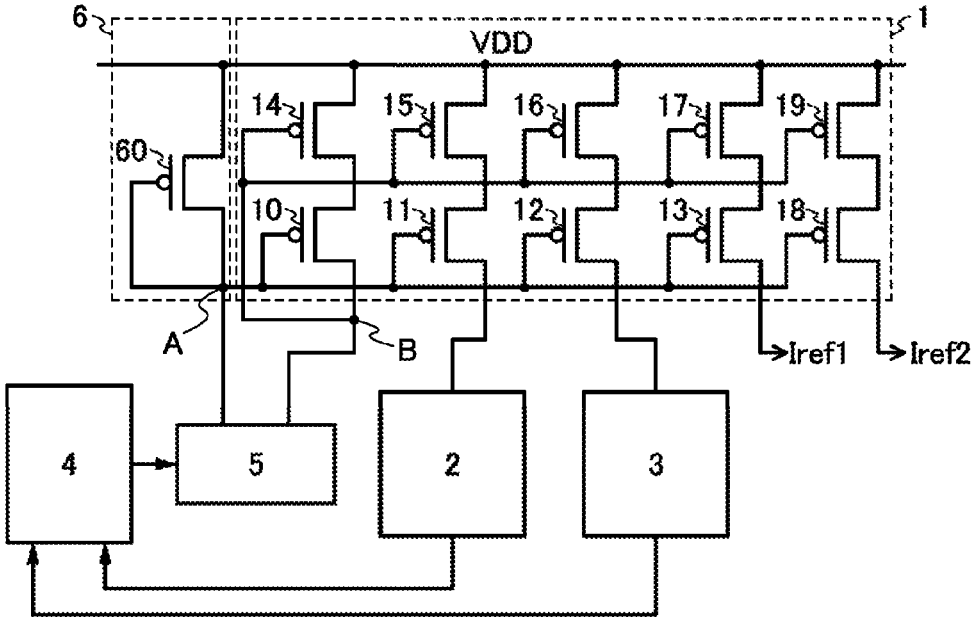

Further, the cascode current mirror circuit 1 outputting one reference current Iref is shown in FIG. 1B; however, the cascode current mirror circuit 1 can output a plurality of reference currents. For example, as shown in FIG. 2B, two p-channel transistors 18 and 19 are added to the cascode current mirror circuit 1 shown in FIG. 1B, so that two reference currents ken and Iref2 can be output from drains of the p-channel transistors 13 and 18. Specifically, a gate of the p-channel transistor 18 shown in FIG. 2B is electrically connected to the node A to which the current I3 is output from the voltage-current converter circuit 5. A gate of the p-channel transistor 19 is electrically connected to the node B to which the current I4 is output from the voltage-current converter circuit 5. A drain of the p-channel transistor 19 is electrically connected to a source of the p-channel transistor 18. A source of the p-channel transistor 19 is electrically connected to a high power supply potential line. Note that the reference current generating circuit outputs two reference currents Iref1 and Iref2 in FIG. 2B; however, three or more reference currents can be output from the reference current generating circuit by adding p-channel transistors connected in a manner similar to those of the p-channel transistors 18 and 19.

Moreover, a plurality of reference currents showing different values can be generated in the reference current generating circuit. For example, the reference current Iref1 can be different from the reference current Iref2 by setting the (W/L) values of the p-channel transistors 18 and 19 included in the cascode current mirror circuit shown in FIG. 2B to be different from the (KC) values of the p-channel transistors 13 and 17. Note that when the reference current generating circuit outputs three or more reference currents, the three or more reference currents can be different from each other.

Note that a plurality of examples described as the modification examples of the reference current generating circuit can be applied to the reference current generating circuit shown in FIG. 1A.

<Structural Example of Reference Voltage Generating Circuit>

Figure 3A:
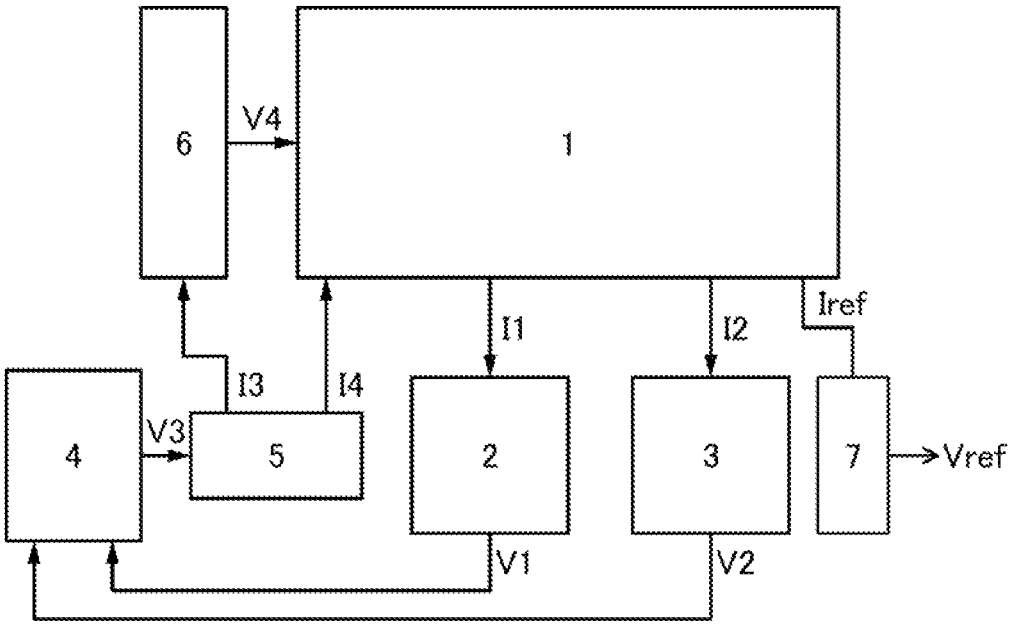
FIGS. 3A to 3C are a circuit diagram showing a structural example of a reference voltage generating circuit and circuit diagrams showing structural examples of a current-voltage converter circuit.

FIG. 3A is a diagram showing a structural example of a reference voltage generating circuit according to one embodiment of the present invention. In the reference voltage generating circuit shown in FIG. 3A, a current-voltage converter circuit 7 converting the reference current Iref into the reference voltage Vref is added to the reference current generating circuit shown in FIG. 1A. As the current-voltage converter circuit 7, circuits shown in FIGS. 3B and 3C can be used. The current-voltage converter circuit 7 shown in FIG. 3B includes a resistor 70 whose one end is electrically connected to a node to which the reference current Iref is output and whose the other end is electrically connected to a wiring supplying a low power supply potential (VSS) (also referred to as a low power supply potential line). The current-voltage converter circuit 7 shown in FIG. 3C includes a resistor 71 whose one end is electrically connected to a node to which the reference current Iref is output and a diode 72 whose anode is electrically connected to the other end of the resistor 71 and whose cathode is electrically connected to a low power supply potential line.

The reference voltage generating circuit shown in FIG. 3A generates a reference voltage by using the reference current generating circuit. Thus, the reference voltage generating circuit with high accuracy and capable of low power supply voltage operation can be provided.

Figure 3B:
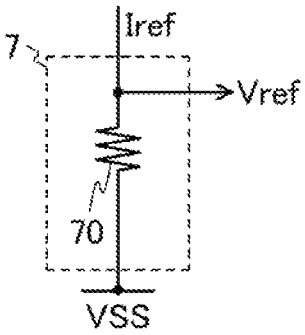
Figure 3C:
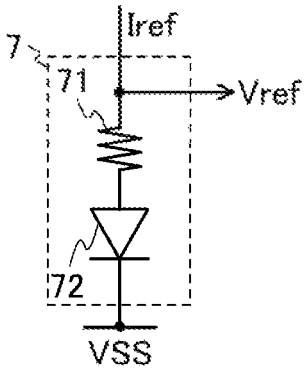
Figure 4:
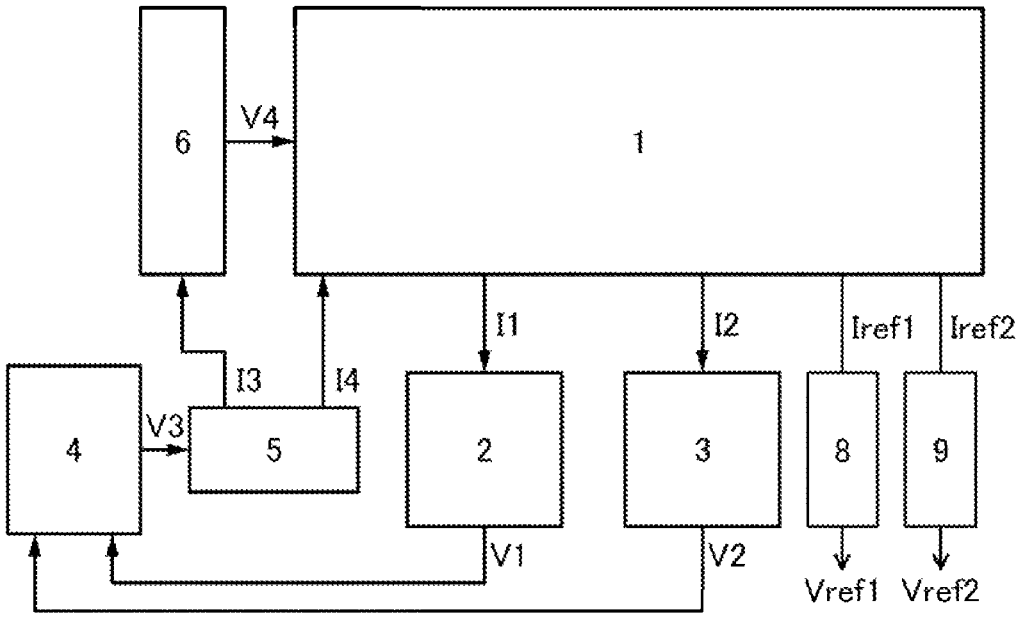
FIG. 4 is a circuit diagram showing a modification example of a reference voltage generating circuit.

Further, the reference voltage generating circuit according to one embodiment of the present invention can include a reference current generating circuit capable of generating a plurality of reference currents as described with reference to FIG. 2B. FIG. 4 shows a structural example of a reference voltage generating circuit in such a case. In the reference voltage generating circuit shown in FIG. 4, a current-voltage converter circuit 8 converting the reference current Iref1 into a reference voltage Vref1 and a current-voltage converter circuit 9 converting the reference current Iref2 into a reference voltage Vref2 are added to the reference current generating circuit shown in FIG. 2B. As the current-voltage converter circuits 8 and 9, the circuits shown in FIGS. 3B and 3C can be used. Further, the reference voltage generating circuit outputs two reference voltages Vref1 and Vref2 in FIG. 4; however, the reference current generating circuit outputting three or more reference currents can be used to output three or more reference voltages.

The reference voltage generating circuit shown in FIG. 4 can generate a plurality of reference voltages showing different values in addition to providing the effect which the reference voltage generating circuit shown in FIG. 3A has. For example, the circuit shown in FIG. 3B is used as the current-voltage converter circuits 8 and 9 shown in FIG. 4 and the loads of the resistors 70 included in the current-voltage converter circuits 8 and 9 are different from each other so that a plurality of reference voltages showing different values can be generated.

<Structural Example of Temperature Detection Circuit>

Figure 5:
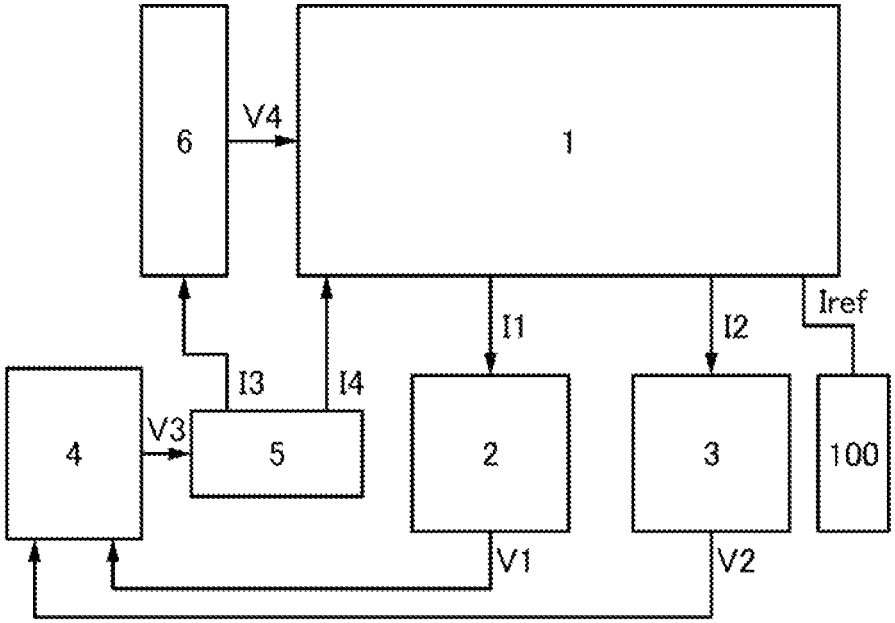
FIG. 5 is a circuit diagram showing a structural example of a temperature detection circuit.

FIG. 5 is a diagram showing a structural example of a temperature detection circuit according to one embodiment of the present invention. In the temperature detection circuit shown in FIG. 5, a detection circuit 100 is added to the reference current generating circuit shown in FIG. 1A. In the temperature detection circuit shown in FIG. 5, temperature can be detected in the detection circuit 100 with the use of a reference current depending on temperature. In other words, in the reference current generating circuit, a current with a small temperature coefficient is obtained by addition of a current having a positive temperature coefficient and a current having a negative temperature coefficient; moreover, when conditions of the addition of these currents are changed as appropriate, a current depending on temperature (a so-called proportional to absolute temperature (PTAT) current) can be obtained. For this reason, temperature can be detected by using this current. The reference voltage generating circuit shown in FIG. 5 generates a reference voltage by using the reference current generating circuit. Thus, the temperature detection circuit with high accuracy and capable of low power supply voltage operation can be provided.

<Specific Example of Various Circuits Included in Reference Current Generating Circuit>

Structures of various circuits (the current-voltage converter circuits 2 and 3, the differential amplifier 4, and the voltage-current converter circuit 5 shown in FIGS. 1A and 1B, FIGS. 2A and 2B, FIG. 3A, FIG. 4, and FIG. 5) included in the reference current generating circuit disclosed in this specification are not limited to certain structures.

Figure 6A:
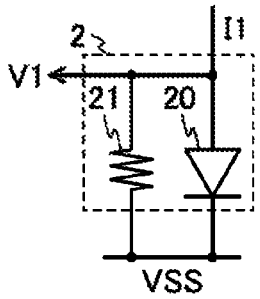
FIGS. 6A to 6D, FIG. 6E, FIG. 6F, and FIG. 6G are circuit diagrams showing structural examples of a current-voltage converter circuit, a circuit diagram showing a structural example of a differential amplifier, a circuit diagram showing a structural example of an operational amplifier, and a circuit diagram showing a structural example of a voltage-current converter circuit respectively.
Figure 6B:
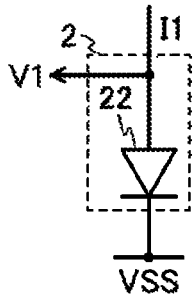

For example, as the current-voltage converter circuit 2, circuits shown in FIGS. 6A and 6B can be used. Specifically, the current-voltage converter circuit 2 shown in FIG. 6A includes a diode 20 whose anode is electrically connected to a node to which the current I1 is output and whose cathode is electrically connected to a low power supply potential line, and a resistor 21 whose one end is electrically connected to the node and whose the other end is electrically connected to the low power supply potential line. The current-voltage converter circuit 2 shown in FIG. 6A outputs the voltage of the node as the voltage V1. The current-voltage converter circuit 2 shown in FIG. 6B includes a diode 22 whose anode is electrically connected to a node to which the current I1 is output and whose cathode is electrically connected to a low power supply potential line. The current-voltage converter circuit 2 shown in FIG. 6B outputs the voltage of the node as the voltage V1.

Figure 6C:
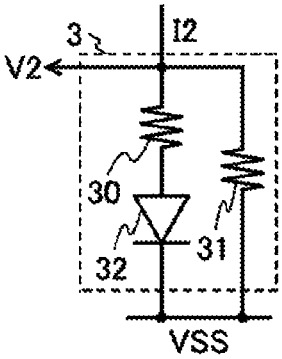
Figure 6D:
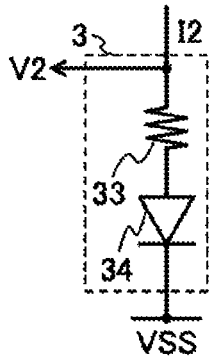

As the current-voltage converter circuit 3, circuits shown in FIGS. 6C and 6D can be used. Specifically, the current-voltage converter circuit 3 shown in FIG. 6C includes a resistor 30 whose one end is electrically connected to a node to which the current I2 is output, a resistor 31 whose one end is electrically connected to the node and whose the other end is electrically connected to a low power supply potential line, and a diode 32 whose anode is electrically connected to the other end of the resistor 30 and whose cathode is electrically connected to the low power supply potential line. The current-voltage converter circuit 3 shown in FIG. 6C outputs the voltage of the node as the voltage V2. The current-voltage converter circuit 3 shown in FIG. 6D includes a resistor 33 whose one end is electrically connected to a node to which the current I2 is output and a diode 34 whose anode is electrically connected to the other end of the resistor 33 and whose cathode is electrically connected to a low power supply potential line. The current-voltage converter circuit 3 shown in FIG. 6D outputs the voltage of the node as the voltage V2. Note that the diode 32 shown in FIG. 6C and the diode 34 shown in FIG. 6D can be replaced with N (N is a natural number greater than or equal to 2) diodes connected in parallel.

Figure 6E:
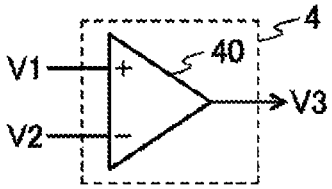
Figure 6F:
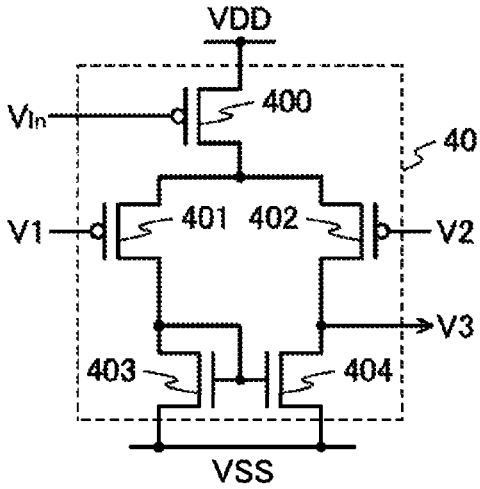

As the differential amplifier 4, an operational amplifier 40 shown in FIG. 6E can be used. In this case, the voltage V1 is input to a non-inverting input terminal of the operational amplifier 40 and the voltage V2 is input to an inverting input terminal of the operational amplifier 40. A specific structural example of the operational amplifier 40 is shown in FIG. 6F. The operational amplifier 40 shown in FIG. 6F includes a p-channel transistor 400 whose source is electrically connected to a high power supply potential line, p-channel transistors 401 and 402 whose sources are electrically connected to a drain of the p-channel transistor 400, an n-channel transistor 403 whose gate and drain are electrically connected to a drain of the p-channel transistor 401 and whose source is electrically connected to a low power supply potential line, and an n-channel transistor 404 whose gate is electrically connected to the drain of the p-channel transistor 401, whose drain is electrically connected to a drain of the p-channel transistor 402, and whose source is electrically connected to the low power supply potential line. A bias voltage ($V_{bn}$) for applying a current, the voltage V1, and the voltage V2 are input to the gate of the p-channel transistor 400, a gate of the p-channel transistor 401, and a gate of the p-channel transistor 402 respectively.

Figure 6G:
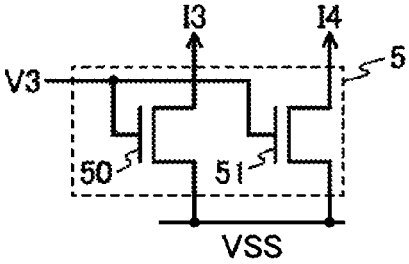

As the voltage-current converter circuit 5, a circuit shown in FIG. 6G can be used. Specifically, the voltage-current converter circuit 5 shown in FIG. 6G includes an n-channel transistor 50 whose gate is electrically connected to a node to which the voltage V3 is output and whose source is electrically connected to a low power supply potential line, and an n-channel transistor 51 whose gate is electrically connected to the node and whose source is electrically connected to the low power supply potential The voltage-current converter circuit 5 shown in FIG. 6G outputs the current I3 from a drain of the n-channel transistor 50 and the current I4 from a drain of the n-channel transistor 51.

This application is based on Japanese Patent Application serial No. 2010-215170 filed with Japan Patent Office on Sep. 27, 2010, the entire contents of which are hereby incorporated by reference.

What is claimed is:

1. A semiconductor circuit comprising:

a first current-voltage converter circuit comprising a first p-channel transistor; and a cascode current mirror circuit comprising second to ninth p-channel transistors, wherein gates of the first to fifth p-channel transistors and a drain of the first p-channel transistor are electrically connected to a third node, wherein a drain of the second p-channel transistor and gates of the sixth to ninth p-channel transistors are electrically connected to a fourth node, wherein a drain of the third p-channel transistor is electrically connected to a first node, wherein a drain of the fourth p-channel transistor is electrically connected to a second node, wherein a drain of the sixth p-channel transistor is electrically connected to a source of the second p-channel transistor, wherein a drain of the seventh p-channel transistor is electrically connected to a source of the third p-channel transistor, wherein a drain of the eighth p-channel transistor is electrically connected to a source of the fourth p-channel transistor, wherein a drain of the ninth p-channel transistor is electrically connected to a source of the fifth p-channel transistor, wherein a source of the first p-channel transistor and sources of the sixth to ninth p-channel transistors are electrically connected to a high power supply potential line, wherein the first node is electrically connected to a first input terminal of a differential amplifier, wherein the second node is electrically connected to a second input terminal of the differential amplifier, wherein an output terminal of the differential amplifier is electrically connected to a gate of a tenth transistor and a gate of an eleventh transistor, wherein a drain of the tenth transistor is electrically connected to the third node, and wherein a drain of the eleventh transistor is electrically connected to the fourth node.

2. The semiconductor circuit according to claim 1, wherein a reference current is output from a drain of the fifth p-channel transistor.

3. The semiconductor circuit according to claim 2, further comprising:

a fourth current-voltage converter circuit converting the reference current into a reference voltage.

4. The semiconductor circuit according to claim 2, further comprising:

a temperature detection circuit comprising:

a detection circuit detecting temperature using the reference current.

5. A semiconductor circuit comprising:

a first current-voltage converter circuit comprising a first p-channel transistor and a second p-channel transistor; and a cascode current mirror circuit comprising third to tenth p-channel transistors, wherein gates of the first to sixth p-channel transistors and a drain of the first p-channel transistor are electrically connected to a third node, wherein a drain of the second p-channel transistor is electrically connected to a source of the first p-channel transistor, wherein a drain of the third p-channel transistor and gates of the seventh to tenth p-channel transistors are electrically connected to a fourth node, wherein a drain of the fourth p-channel transistor is electrically connected to a first node, wherein a drain of the fifth p-channel transistor is electrically connected to a second node, wherein a drain of the seventh p-channel transistor is electrically connected to a source of the third p-channel transistor, wherein a drain of the eighth p-channel transistor is electrically connected to a source of the fourth p-channel transistor, wherein a drain of the ninth p-channel transistor is electrically connected to a source of the fifth p-channel transistor, wherein a drain of the tenth p-channel transistor is electrically connected to a source of the sixth p-channel transistor, wherein a source of the second p-channel transistor and sources of the seventh to tenth p-channel transistors are electrically connected to a high power supply potential line, wherein the first node is electrically connected to a first input terminal of a differential amplifier, wherein the second node is electrically connected to a second input terminal of the differential amplifier, wherein an output terminal of the differential amplifier is electrically connected to a gate of an eleventh transistor and a gate of a twelfth transistor, wherein a drain of the eleventh transistor is electrically connected to the third node, and wherein a drain of the twelfth transistor is electrically connected to the fourth node.

6. The semiconductor circuit according to claim 5, wherein a reference current is output from the drain of the fifth p-channel transistor.

7. The semiconductor circuit according to claim 6, further comprising:

a second current-voltage converter circuit converting the reference current into a reference voltage.

8. The semiconductor circuit according to claim 6, further comprising:

a temperature detection circuit comprising:

a detection circuit detecting temperature using the reference current.

9. A semiconductor circuit comprising:

a first current-voltage converter circuit comprising a first p-channel transistor; and a cascode current mirror circuit comprising second to ninth p-channel transistors, wherein gates of the first to fifth p-channel transistors and a drain of the first p-channel transistor are electrically connected to a third node, wherein a drain of the second p-channel transistor and gates of the sixth to ninth p-channel transistors are electrically connected to a fourth node, wherein a drain of the third p-channel transistor is electrically connected to a first node, wherein a drain of the fourth p-channel transistor is electrically connected to a second node, wherein a drain of the sixth p-channel transistor is electrically connected to a source of the second p-channel transistor, wherein a drain of the seventh p-channel transistor is electrically connected to a source of the third p-channel transistor, wherein a drain of the eighth p-channel transistor is electrically connected to a source of the fourth p-channel transistor, wherein a drain of the ninth p-channel transistor is electrically connected to a source of the fifth p-channel transistor, wherein a source of the first p-channel transistor and sources of the sixth to ninth p-channel transistors are electrically connected to a high power supply potential line, wherein the first node is electrically connected to a first input terminal of a second current-voltage converter circuit, wherein the second node is electrically connected to a second input terminal of a third current-voltage converter circuit, wherein a first output terminal of the second current-voltage converter circuit is electrically connected to a third input terminal of a differential amplifier, wherein a second output terminal of the third current-voltage converter circuit is electrically connected to a fourth input terminal of the differential amplifier, wherein a third output terminal of the differential amplifier is electrically connected to a fifth input terminal of a voltage-current converter circuit, and wherein a fourth output terminal of the voltage-current converter circuit is electrically connected to the third node, and a fifth output terminal of the voltage-current converter circuit is electrically connected to the fourth node.

10. The semiconductor circuit according to claim 9, wherein the second current-voltage converter circuit is configured to receive a first mirror current from the first node of the cascode current mirror circuit and convert the first mirror current into a first voltage, wherein the third current-voltage converter circuit is configured to receive a second mirror current from the second node of the cascode current mirror circuit and convert the second mirror current into a second voltage, wherein the first voltage is input to the third input terminal of the differential amplifier and the second voltage is input to the fourth input terminal of the differential amplifier, the first voltage and the second voltage being converted into a third voltage by the differential amplifier, wherein the voltage-current converter circuit is configured to receive the third voltage and convert the third voltage into a third current to output to the third node, and into a fourth current to output to the fourth node, and wherein the first current-voltage converter circuit is configured to convert the third current into a fourth voltage to output to the cascode current mirror circuit.

11. The semiconductor circuit according to claim 9, wherein a reference current is output from a drain of the fifth p-channel transistor.

12. The semiconductor circuit according to claim 11, further comprising:

a fourth current-voltage converter circuit converting the reference current into a reference voltage.

13. The semiconductor circuit according to claim 11, further comprising:

a temperature detection circuit comprising:

a detection circuit detecting temperature using the reference current.

14. A semiconductor circuit comprising:

a first current-voltage converter circuit comprising a first p-channel transistor and a second p-channel transistor; and a cascode current mirror circuit comprising third to tenth p-channel transistors, wherein gates of the first to sixth p-channel transistors and a drain of the first p-channel transistor are electrically connected to a third node, wherein a drain of the second p-channel transistor is electrically connected to a source of the first p-channel transistor, wherein a drain of the third p-channel transistor and gates of the seventh to tenth p-channel transistors are electrically connected to a fourth node, wherein a drain of the fourth p-channel transistor is electrically connected to a first node, wherein a drain of the fifth p-channel transistor is electrically connected to a second node, wherein a drain of the seventh p-channel transistor is electrically connected to a source of the third p-channel transistor, wherein a drain of the eighth p-channel transistor is electrically connected to a source of the fourth p-channel transistor, wherein a drain of the ninth p-channel transistor is electrically connected to a source of the fifth p-channel transistor, wherein a drain of the tenth p-channel transistor is electrically connected to a source of the sixth p-channel transistor, and wherein a source of the second p-channel transistor and sources of the seventh to tenth p-channel transistors are electrically connected to a high power supply potential line, wherein the first node is electrically connected to a first input terminal of a second current-voltage converter circuit, wherein the second node is electrically connected to a second input terminal of a third current-voltage converter circuit, wherein a first output terminal of the second current-voltage converter circuit is electrically connected to a third input terminal of a differential amplifier, wherein a second output terminal of the third current-voltage converter circuit is electrically connected to a fourth input terminal of the differential amplifier, wherein a third output terminal of the differential amplifier is electrically connected to a fifth input terminal of a voltage-current converter circuit, and wherein a fourth output terminal of the voltage-current converter circuit is electrically connected to the third node, and a fifth output terminal of the voltage-current converter circuit is electrically connected to the fourth node.

15. The semiconductor circuit according to claim 14, wherein the second current-voltage converter circuit is configured to receive a first mirror current from the first node of the cascode current mirror circuit and convert the first mirror current into a first voltage, wherein the third current-voltage converter circuit is configured to receive a second mirror current from the second node of the cascode current mirror circuit and convert the second mirror current into a second voltage, wherein the first voltage is input to the third input terminal of the differential amplifier and the second voltage is input to a fourth input terminal of the differential amplifier, the first voltage and the second voltage being converted into a third voltage by the differential amplifier, wherein the voltage-current converter circuit is configured to receive the third voltage and convert the third voltage into a third current to output to the third node, and into a fourth current to output to the fourth node, and wherein the first current-voltage converter circuit is configured to convert the third current into a fourth voltage to output to the cascode current mirror circuit.

16. The semiconductor circuit according to claim 14, wherein a reference current is output from the drain of the fifth p-channel transistor.

17. The semiconductor circuit according to claim 16, further comprising:

a fourth current-voltage converter circuit converting the reference current into a reference voltage.

18. The semiconductor circuit according to claim 16, further comprising:

a temperature detection circuit comprising:

a detection circuit detecting temperature using the reference current.

* * * * *

UNITED STATES PATENT AND TRADEMARK OFFICE

CERTIFICATE OF CORRECTION

PATENT NO. : 8,638,162 B2
APPLICATION NO. : 13/243290
DATED : January 28, 2014
INVENTOR(S) : Kazunori Watanabe It is certified that error appears in the above-identified patent and that said Letters Patent is hereby corrected as shown below:

In the Specification

Column 3, line 6, replace “cascade” with --cascode--;

Column 5, line 18, replace “Of” with --of--;

Column 7, line 66, replace “ken” with --Iref1--;

Column 8, line 21, replace “(KC)” with --(W/L)--;

Column 10, line 38, replace “($V_{In}$)” with --($V_{In}$)--;

Column 10, line 51, after “potential” insert --line.--.

Signed and Sealed this
Tenth Day of February, 2015

Michelle K. Lee

Michelle K. Lee
*Deputy Director of the United States Patent and Trademark Office*